US008622381B2

(12) United States Patent
Aoki et al.

(10) Patent No.: US 8,622,381 B2
(45) Date of Patent: Jan. 7, 2014

(54) SHEET SUPPLY APPARATUS

(71) Applicants: Hirotaka Aoki, Nagoya (JP); Tetsuo Asada, Kuwana (JP)

(72) Inventors: Hirotaka Aoki, Nagoya (JP); Tetsuo Asada, Kuwana (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/837,582

(22) Filed: Mar. 15, 2013

(65) Prior Publication Data

US 2013/0256977 A1 Oct. 3, 2013

(30) Foreign Application Priority Data

Mar. 29, 2012 (JP) ..... 2012-075314

(51) Int. Cl.
*B65H 3/52* (2006.01)

(52) U.S. Cl.
USPC ..... 271/117; 271/121; 271/122

(58) Field of Classification Search
USPC ..... 271/117, 118, 121, 122
See application file for complete search history.

(56) References Cited

U.S. PATENT DOCUMENTS 7,455,287 B2 * 11/2008 Shiohara et al. ..... 271/121
8,113,502 B2 * 2/2012 Kozaki et al. ..... 271/117

FOREIGN PATENT DOCUMENTS

JP H01-127532 A 5/1989
JP 2002-087615 A 3/2002
JP 2002-128304 A 5/2002
JP 2006-151674 A 6/2006

* cited by examiner

*Primary Examiner* — Luis A Gonzalez
(74) *Attorney, Agent, or Firm* — Baker Botts L.L.P.

(57) ABSTRACT

An image recording apparatus includes a supply tray and a supply unit. The supply unit includes a supporting shaft, an arm configured to pivot around the supporting shaft, and, a first roller and a second roller which are provided in the arm. The first and second rollers are pressedly contacted with a sheet placed on the supply tray. The supply tray is provided with a contact portion. The contact portion includes a first contact portion facing to the first roller and second rollers, and a second contact portion disposed in an upstream side of the first contact portion in the supply direction. A friction coefficient of the second contact portion is smaller than that of the first contact portion. When the first and second rollers rotatingly moves on the sheet, a friction force is applied by the second contact portion to the sheet.

11 Claims, 11 Drawing Sheets

SHEET SUPPLY APPARATUS

CROSS REFERENCE TO RELATED APPLICATION

The present application claims priority from Japanese Patent Application No. 2012-075314, which was filed on Mar. 29, 2012, the disclosure of which is herein incorporated by reference in its entirety.

BACKGROUND OF THE INVENTION

1. Field of the Invention

The present invention relates to a sheet supply apparatus in which a sheet supply roller is come into abutting contact with a sheet by a pivot of an arm.

2. Description of Related Art

A sheet supply apparatus which supplies a sheet placed on a sheet placed member by a rotation of the sheet supply roller is known. The sheet supply apparatus is used for an image recording apparatus which carries a sheet and records an image on the sheet, and for a scanner which carries a sheet (an image recorded sheet) and scans an image on the sheet.

In some sheet supply apparatuses, the sheet supply roller is come into abutting contact with a sheet. It is known that, in such a sheet supply apparatus, a friction member configured to apply a friction force to the sheet is provided in the sheet placed member in order to decrease a probability of a double-feeding of the sheets.

A conventional art discloses a sheet supply apparatus provided with a separation pad which can slide in a sheet supply direction for a sheet in order to prevent an occurrence of a no-feeding of the sheet. There is a sheet supply apparatus provided with a separation pad which can slide in a sheet supply direction in order to prevent an occurrence of a no-feeding of the sheet. The separation pad includes a block pad having a high friction generating face generating a relatively large friction force, and a separation pad base having a low friction generating face generating a relatively small friction force. The block pad is provided in an upstream side of the small friction face in the sheet supply direction. The separation pad is slidably provided such that it slides to a position at which the block pad faces to the sheet supply roller and to a position at which the small friction face faces to the sheet supply roller. A spring pushes the block pad toward the position at which the block pad faces to the sheet supply roller.

SUMMARY OF THE INVENTION

Since the separation pad is slidably provided, an angle of the arm does not vary, thereby causing no increase of a conveying force applied to the sheet. Therefore, it takes a relatively long time to supply the sheet.

The present invention is carried out in the light of such a problem, therefore, it is an object of the present invention to provide a sheet supply apparatus capable of preventing an occurrence of the no-feeding of the sheet.

The object indicated above may be achieved according to the present invention which provides a sheet supply apparatus comprising: a sheet support portion configured to support at least one sheet; a supporting shaft supported by a main body of the sheet supply apparatus; an arm configured to pivot around the supporting shaft; a sheet supply roller provided at a distal end of the arm and configured to supply the at least one sheet in a sheet supply direction in which the at least one sheet is supplied; and a contact portion fixed to the sheet support portion and facing to the sheet supply roller, wherein the contact portion comprises: a first contact portion; and a second contact portion disposed in an upstream side of the first contact portion in the sheet supply direction and having a friction coefficient smaller than a friction coefficient of the first contact portion, wherein the sheet supply roller is configured to move from a first position at which the sheet supply roller faces to the first contact portion to a second position at which the sheet supply roller faces to the second contact portion, by an elastic deformation of at least one of the sheet support portion, the contact portion, the supporting shaft, the arm, and the sheet supply roller.

BRIEF DESCRIPTION OF THE DRAWINGS

The objects, features, advantages, and technical and industrial significance of the present invention will be better understood by reading the following detailed description of an embodiment of the invention, when considered in connection with the accompanying drawings, in which:

FIGS. 5A-5C are schematic views of a sheet supply tray 14, a sheet supply roller 19, and a contact portion 80, wherein FIG. 5A is a cross-sectional view of the sheet supply tray 14 taken in front-rear direction, FIG. 5B is a cross-sectional view of the sheet supply tray 14 and the sheet supply roller 19 taken through the contact portion 80 in a direction perpendicular to the front-rear direction, and FIG. 5C is a plan view of the contact portion 80;

FIGS. 8A-8E are schematic views of a contact portion 80, wherein FIG. 8A is a plan view of a contact portion 80 of a first modified embodiment, FIG. 8B is an exploded view of the contact portion 80 shown in FIG. 8A, FIG. 8C is a plan view of a contact portion 80 of the first modified embodiment, and FIGS. 8D and 8E are plan views of the contact portions 80 of the first modified embodiment having respective other profiles;

FIGS. 9A-9C are schematic views of the contact portion 80 and the sheet supply roller 19, wherein FIG. 9A is a plan view of a contact portion 80 of a second modified embodiment, FIG. 9B is an exploded view of the contact portion 80 shown in FIG. 9A, and FIG. 9C is an explanatory diagram for describing an operation of a sheet supply roller 19 of the second modified embodiment;

FIGS. 10A and 10B are schematic views of a sheet supply unit 20, wherein FIG. 10A is a perspective view of a sheet supply unit 20 and the sheet supply unit 20 of a third modified embodiment, and FIG. 10B is a cross-sectional view of the sheet supply unit 20 and the sheet supply unit 14 of the third modified embodiment, taken in the front-rear direction.

DETAILED DESCRIPTION OF THE PREFERRED EMBODIMENTS

Embodiments according to the present invention is described below. It should be understood that the embodiments described and illustrated herein are only exemplary. The embodiments may be modified and varied without deviating from the scope and spirit of the present invention.

Figure 1:
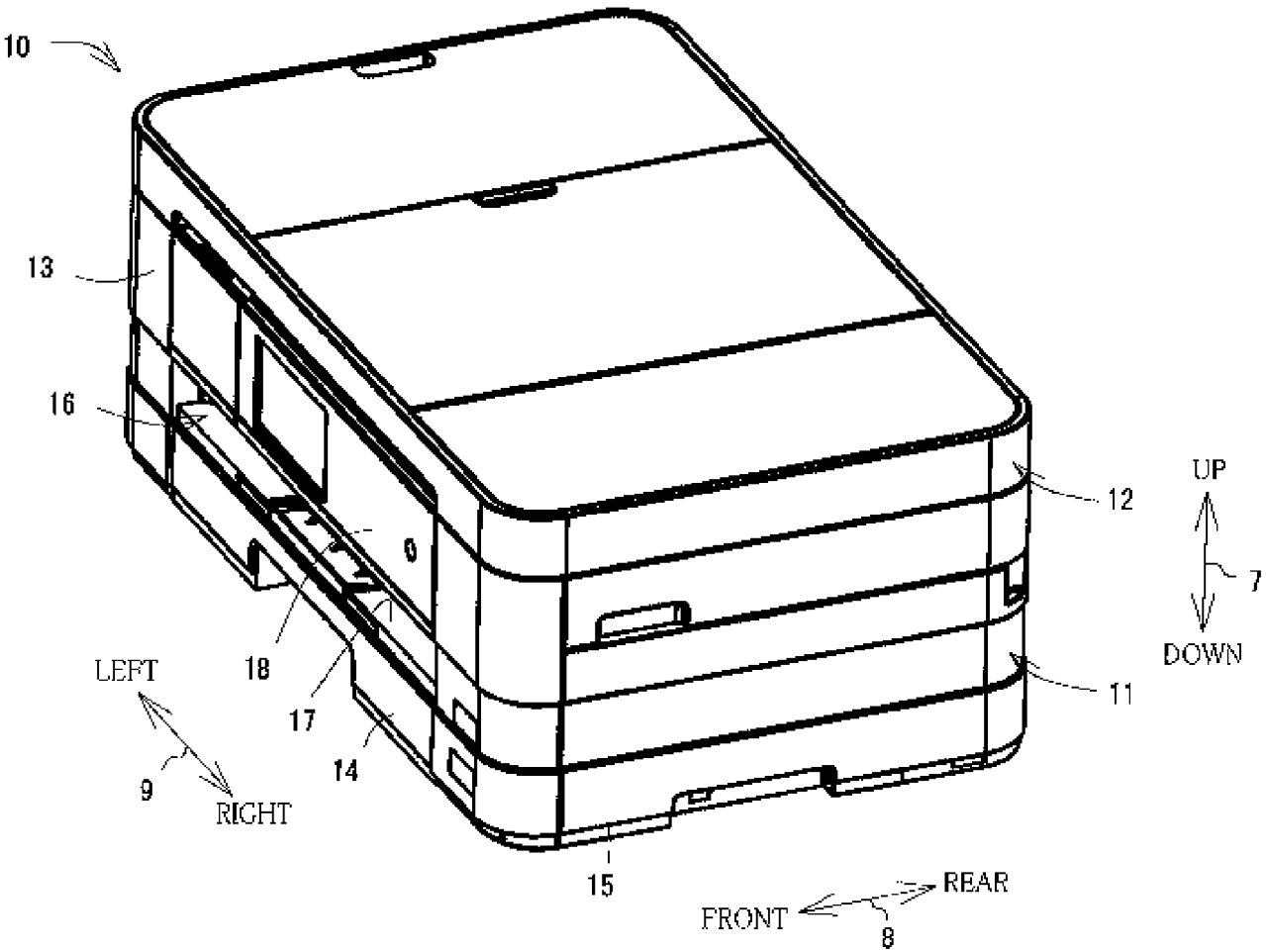
FIG. 1 is a perspective view of the image recording apparatus 10.

In the following description, an up-down direction 7 is defined with respect to the image recording apparatus 10 installed in an operable state (FIG. 1). In addition, the image recording apparatus 10 has an operation panel 18 on one side face of the image recording apparatus 10. This one side face is referred as a front face of the image recording apparatus 10, and a front-rear direction 8 is defined with reference to a position of the front face. In addition, a left-right direction 9 is defined based on a point of view in front of the image recording apparatus 10.

Image Recording Apparatus 10

Figure 2:
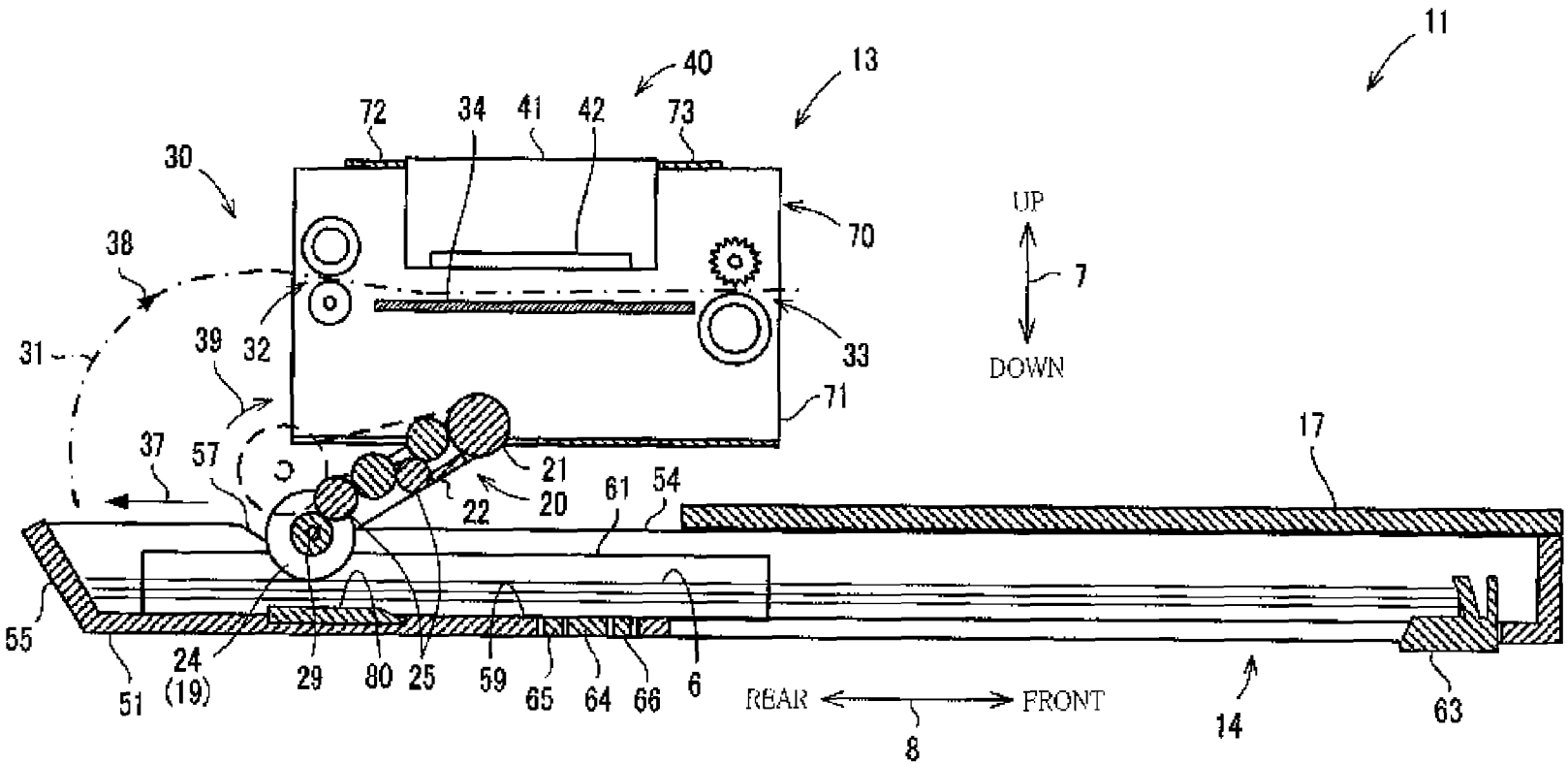
FIG. 2 is a schematic cross-sectional view of a printer unit 11 taken in a front-rear direction.

As shown in FIG. 1, the image recording apparatus 10 has a printer unit 11 and a scanner unit 12. The printer unit 11 records an image on a sheet 6 (FIG. 2). The sheet 6 is, for example, a plain paper, a gloss paper, and a postcard. The scanner unit 12 scans an image on an image recorded sheet (not shown). The image recording apparatus 10 performs a printing, a scanning, a copying, and so on by means of the printer unit 11 and the scanner unit 12. The scanner unit 12 has any known constitution, and thus a detailed description thereof is omitted herein.

Printer Unit 11

As shown in FIG. 1, the image recording apparatus 11 has an apparatus main body 13 and a sheet supply tray 14. As shown in FIG. 2, the sheet supply tray 14 is generally placed with a plurality of sheets 6. The apparatus main body 13 has a sheet supply unit 20, a convey unit 30, and a recording unit 40. The sheet 6 is supplied by the sheet supply unit 20 from the sheet supply tray 14, and is conveyed by the convey unit 30, and then an image is recorded on the sheet 6. The sheet 6 on which the image has been recorded is discharged to a sheet discharged tray 17. The sheet supply unit 20 and the sheet supply tray 14 constitute one example of a sheet supply apparatus.

Sheet Supply Tray 14

As shown in FIG. 1, the sheet supply tray 14 (which is an example of a sheet support portion) is accommodated in the apparatus main body 13 at a lower portion thereof. The sheet supply tray 14 is inserted into and pulled out of the apparatus main body 13 through an opening 16 provided on a front face of the apparatus main body 13, by a slide of the sheet supply tray 14 in the front-rear direction 8.

As shown in FIG. 2, the sheet supply tray 14 has a bottom plate 51 (which is an example of a sheet support portion) provided with a sheet placed face 59. The sheets 6 are placed on the sheet placed face 59.

The bottom plate 51 is provided with a contact portion 80, and a pair of side guides 61 one of which is arranged in a left side of the bottom plate 51 and the other of which is arranged in a right side of the bottom plate 51. One of the side guides is not shown in the drawings. The contact portion 80 is, as described later, a member which prevents an occurrence of a double-feeding in which a plurality of sheets 6 are fed and supplied at a time.

The pair of side guides 61 is placed on the sheet placed face 59 of the bottom plate 51 such that each of the pair of side guides 61 faces to each other in the left-right direction 9 (a direction vertical to a plane of FIG. 2). The pair of side guides 61 is supported by the bottom plate 51 such that the side guides 61 are freely reciprocatable in the left-right direction 9. Though a detailed description is omitted, each of the pair of side guides 61 is interlocked with each other by a pair of rack gears 65, 66 and a pinion gear 64 so that each of the pair of sides 61 moves in a direction opposite to each other in the left-right direction 9. The pair of side guides 61 is moved to respective positions by a user in order to fit to a size of the placed sheets 6. Accordingly, the sheets 6 are positioned in a center positioning manner. The center positioning manner is a manner in which the sheets 6 are positioned so that centers of the sheets 6 in the left-right direction 9 are aligned at a center of the bottom plate 51 in the left-right direction 9.

A rear guide 63 is arranged in a center of the bottom plate 51 in the left-right direction 9 and is supported by the bottom plate 51 such that the rear guide 63 are freely reciprocatable in the front-rear direction 8 being allowed. The rear guide 63 is moved to a position by the user in order to fit to a size of the placed sheet 6. Therefore, when the sheet 6 is placed on the bottom plate 51, the sheet 6 comes into abutting contact with an inclined plate 55 of the sheet supply tray 14.

The inclined plate 55 extends rearward and upward from a rear edge portion of the bottom plate 51 in the front-rear direction 8. Therefore, the sheet 6 is guided rearward and upward by the inclined plate 55.

Figure 3:
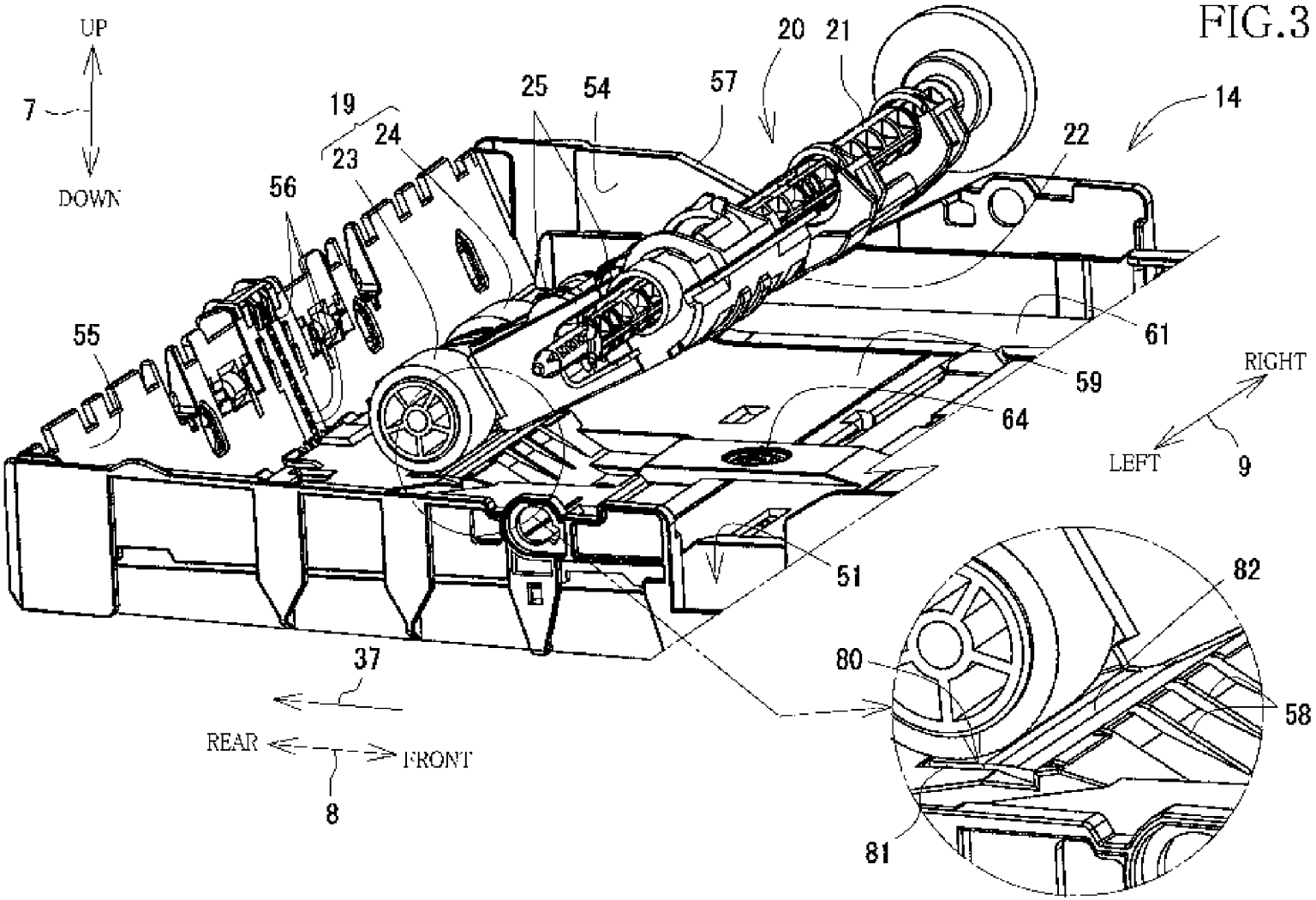
FIG. 3 is a perspective view of a sheet supply unit 20 and a sheet supply tray 14 seen from a front of them.

As shown in FIG. 3, a plurality of separating protrusion pieces 56 are provided on the inclined plate 55. The separating protrusion pieces 56 constitutes a member which comes into abutting contact with leading edges of the sheets 6 (FIG. 2) in a sheet supply direction 37 and separates a top one of the sheets 6 from others of the sheets 6, thereby preventing the double-feeding of the sheets 6. The separating protrusion pieces 56 protrude forward and upward from an inner face of the inclined plate 55. Since the sheets 6 are positioned owing to the center positioning manner, the separating protrusion pieces 56 are provided in a central portion of the inclined plate 55 in the left-right direction 9. The plurality of separating protrusion pieces 56 are arranged between a bottom edge of the inner face of the inclined plate 55 and a top edge of the inner face of the inclined plate 55 such that the separating protrusion piece 56 are separated from each other, in order to prevent the double-feeding irrespective of an amount of the sheets 6.

A right side plate 54 extends upward from a right edge of the bottom plate 51 in the left-right direction 9. The right side plate 54 has an inclined face 57 extending forward and downward from a top face of the right side plate 54. The inclined face 57 constitutes a cam follower for a pivot of an arm 22 to be described later. When the sheet supply tray 14 is loaded in the apparatus main body 13 (FIG. 1), or when the sheet supply tray 14 is pulled out of the apparatus main body 13, the arm 22 is slid on the inclined face 57 so that the arm 22 is pivoted. It is later described in detail.

The sheet supply tray 14 is formed of a plastic material having a low friction coefficient with respect to the arm 22 and the sheet 6 in order to decrease a slide resistance which generates between the arm 22 and the sheet supply tray 14 when the sheet supply tray 14 is inserted into and pulled out of the apparatus main body 13 and in order to decrease a friction force which is applied by the inclined plate 55 to the sheet 6.

Frame 70

As shown in FIG. 2, the apparatus main body 13 has a sheet supply unit 20, a convey unit 30, and a frame 70 (which is an example of a main body) which supports a recording portion 40. These components are described later. The frame 70 is formed in a framed shape by a frame main body 71 formed by bending upward opposite edge portions of a steel plate in the left-right direction 9, and a pair of guide rails 72, 73 constructed between respective top edges of the opposite edge portions of the steel plate in different positions from each other in the front-rear direction 8. The frame 70 is placed above the sheet supply tray 14 and fixed to the housing 15 (FIG. 1).

Sheet Supply Unit 20

Figure 4:
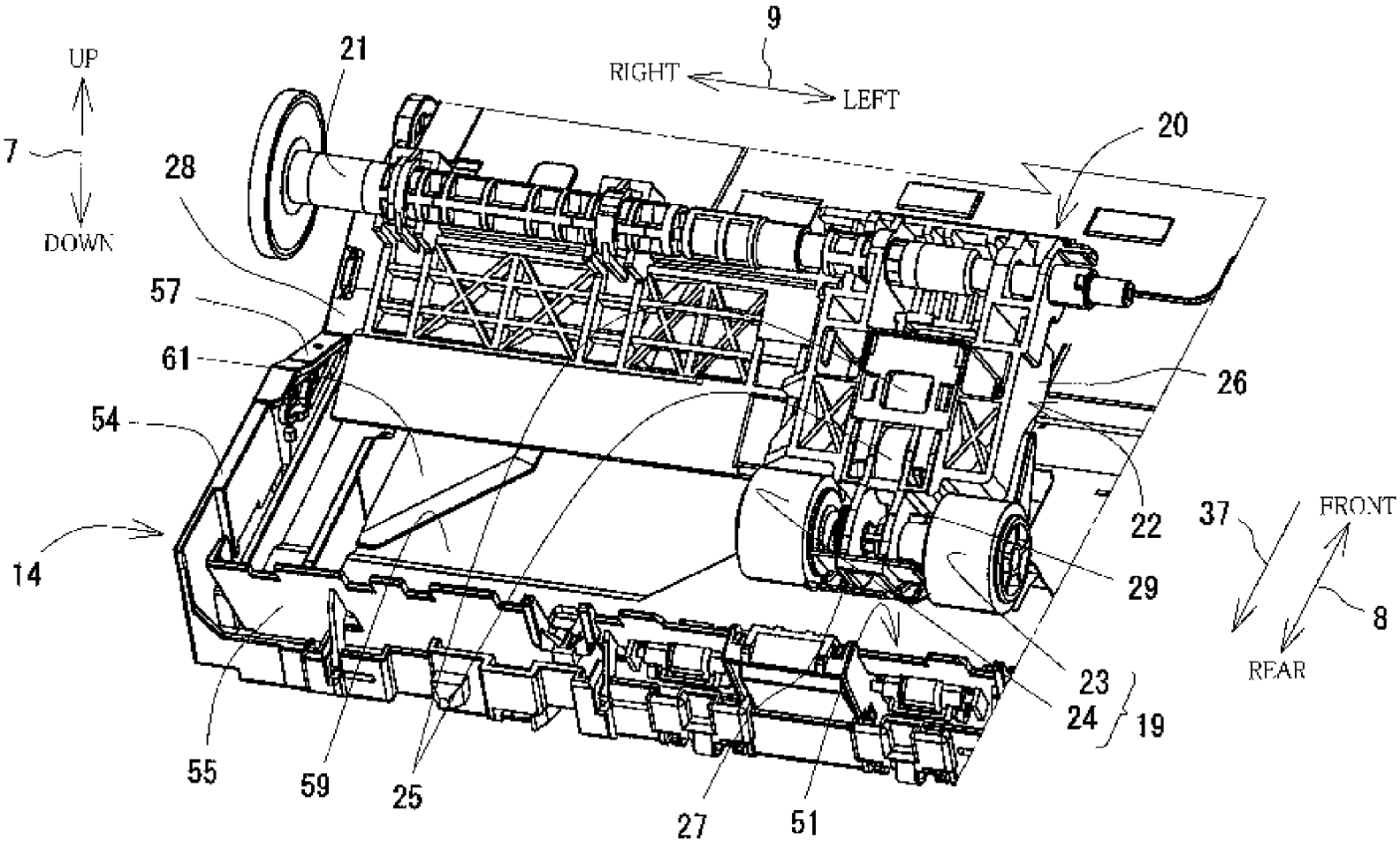
FIG. 4 is a perspective view of the sheet supply unit 20 and the sheet supply tray 14 seen from a rear of them.

As shown in FIG. 4, the sheet supply unit 20 has a supporting shaft 21, the arm 22, a sheet supply roller 19, and a plurality of transmission gears 25. The sheet supply roller 19 has a first roller 23 and a second roller 24.

The supporting shaft 21 extends, in the left-right direction 9, from a space above a right edge portion of the sheet supply tray 14 to a space above a central portion of the sheet supply tray 14, and is rotatably supported by the frame 70 (FIG. 2). The supporting shaft 21 is rotated by a transmission of a drive force generated by an ASF motor not shown in the drawings.

The arm 22 has an arm portion 26 supporting the transmission gears 25, a holder portion 27 supporting a rotation shaft 29 of the sheet supply roller 19, and a cam portion 28 which is slid on the inclined face 57. The arm 22 is a resin molded part.

The arm portion 26 extends rearward and downward from the supporting shaft 21 and is rotatably supported by the supporting shaft 21. The arm portion 26 is arranged above a central portion of the bottom plate 51 in the left-right direction 9 such that the sheet supply roller 19 comes into abutting contact with a central portion of the sheet 6 (FIG. 2) in the left-right direction 9. The arm portion 26 rotatably supports a plurality of transmission gears 25.

The cam portion 28 is disposed in a right region of the arm portion 26 in the left-right direction 9, and is positioned in front of the inclined face 57 of the sheet supply tray 14 in the front-rear direction 8. As described later, the cam portion 28 slides on the inclined face 57 when the sheet supply tray 14 is inserted into and pulled out of the apparatus main body 13 (FIG. 1).

The holder portion 27 is provided in a distal end of the arm portion 26. The holder portion 27 rotatably supports a rotation shaft 29 of the sheet supply roller 19.

The rotation shaft 29 (which is an example of a connection member) is a member like a bar extending in the left-right direction 9 and is supported by the holder portion 27 in a rotatable manner around a central axis of the rotation shaft 29. A left end portion of the rotation shaft 29 in the left-right direction 9 protrudes leftward from a left side face of the holder portion 27. A right end portion of the rotation shaft 29 protrudes rightward from a right side face of the holder portion 27. The rotation shaft 29 is connected at the both left and right end portions thereof to the first roller 23 and the second roller 24.

Each of the first roller 23 and the second roller 24 is formed of a material having elasticity, such as a rubber, and formed into a column shape whose central axis extends along the left-right direction 9. Each of circumferential surfaces of the first roller 23 and the second roller 24 has grooves extending in a rotation axis, and thus each of the circumferential surfaces is knurled. The first roller 23 is arranged in a left side of the holder portion 27 in the left-right direction 9. A left end portion of the rotation shaft 29 in the left-right direction 9 is inserted into a central hub portion of the first roller 23. The second roller 24 is arranged in a right side of the holder portion 27 in the left-right direction 9. A right end portion of the rotation shaft 29 in the left-right direction 9 is inserted into a central hub portion of the second roller 24. The first roller 23 and the second roller 24 are coupled by the rotation shaft 29 and are rotatably supported by the holder portion 27.

As shown in FIG. 2 and FIG. 4, the plurality of transmission gears 25 are provided on the arm portion 26 and are meshed with each other so that a rotation of the supporting shaft 21 is transmitted to the rotation shaft 29. Therefore, the rotation shaft 29 has a passive gear which meshes with the transmission gears 25.

When the sheet supply tray 14 is pulled out of the apparatus main body 13 (FIG. 1), the cam portion 28 of the arm 22 slides on the inclined face 57 of the sheet supply tray 14 so that the arm 22 is pivoted. This pivot raises the sheet supply roller 19 to a height in which the sheet supply roller 19 does not come into abutting contact with the inclined plate 55, as shown in FIG. 2 by a broken line.

When the sheet supply tray 14 is loaded in the apparatus main body 13, the cam portion 28 of the arm 22 slides on the inclined face 57 so that the arm 22 is pivoted. This pivot moves the sheet supply roller 19 downward so that the sheet supply roller 19 come into abutting contact with the sheet 6, as shown in FIG. 2 by a solid line.

The sheet supply roller 19 is pressedly contacted with the sheet 6 by a weight of the arm 22 and a friction force applied by the supporting shaft 21 to the arm 22 due to a rotation of the supporting shaft 21. When the shaft 21 is rotated, the sheet supply roller 19 is rotated in a rotational direction 39 by means of the plurality of transmission gears 25. As a result, the sheet 6 is supplied in the sheet supply direction 37. The supplied sheet 6 is guided by the inclined plate 55 into the conveying path 31.

Convey Unit 30

As shown in FIG. 2, the convey unit 30 has a conveying path 31, a conveyor roller pair 32, and a sheet discharge roller pair 33.

The conveying path 31 is a space through which the sheet 6 passes, and is defined by a platen 34 and a plurality of guide members not shown in the drawings. The plurality of guide members are supported by the frame 70 and the housing 15 (FIG. 1). The platen 34 is arranged below the pair of guide rails 72, 73 and is supported by the frame 70. The conveying path 31 extends upward from an upper end of the inclined plate 55 with a curved shape, and further extends linearly through a space above the platen 34 to a space above the sheet discharged tray 17.

The conveyor roller pair 32 is disposed in an upstream side of the platen 34 in the conveying direction 38 shown by an arrow in FIG. 2, in other words, disposed in the rear of the platen 34 in the front-rear direction 8, and is rotatably supported by the frame 70. The conveyor roller pair 32 is rotated by a transmission of a drive force generated from an LF motor not shown in the drawings so as to nip and convey the sheet 6. The sheet discharge roller pair 33 is disposed in a downstream side of the platen 34 in the conveying direction 38, in other words, disposed in front of the platen 34 in the front-rear direction 8, and is rotatably supported by the frame 70. The sheet discharge roller pair 33 is rotated by a transmission of a drive force generated from an LF motor so as to nip and convey the sheet 6.

Recording Portion 40

As shown in FIG. 2, the recording portion 40 has a carriage 41 and a recording head 42 provided for the carriage 41. The carriage 41 is arranged above the platen 34 and is supported by the pair of guide rails 72, 73 such that the carriage 41 is freely reciprocatable in the left-right direction 9 (the direction vertical to a drawing sheet of FIG. 2). The recording head 42 selectively ejects ink droplets toward the sheet 6 conveyed on the platen 34 so as to record an image on the sheet 6. Alternatively, the recording portion 40 may employ other recording techniques other than the ink-jet recording technique in which an image is recorded by ejecting ink droplets, such as an electrophotographic technique.

Contact Portion 80

The contact portion 80 shown in FIG. 3 comes into abutting contact with the lowest one (bottom one) of the sheets 6 placed on the bottom plate 51 (FIG. 2), and is a member for preventing the double-feeding of the sheets 6 where the sheets 6 are approximately several pieces.

Figure 5A:
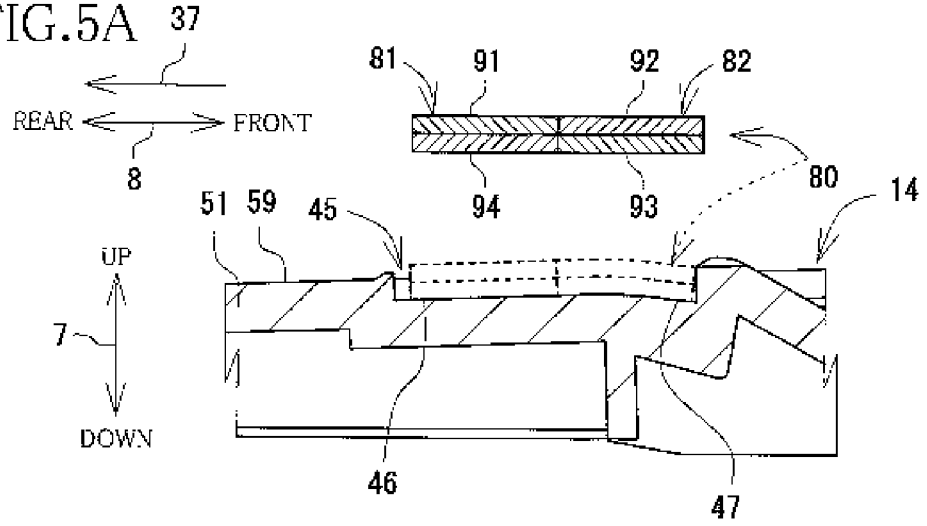
Figure 5B:
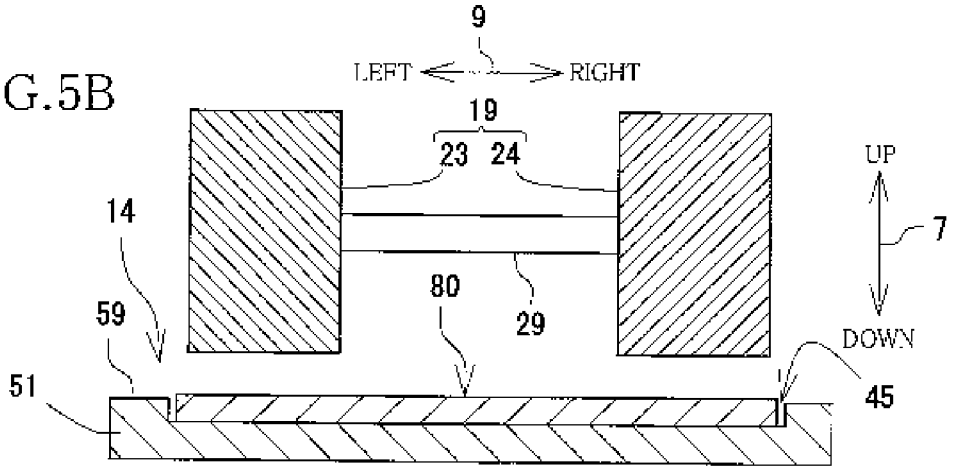
Figure 5C:
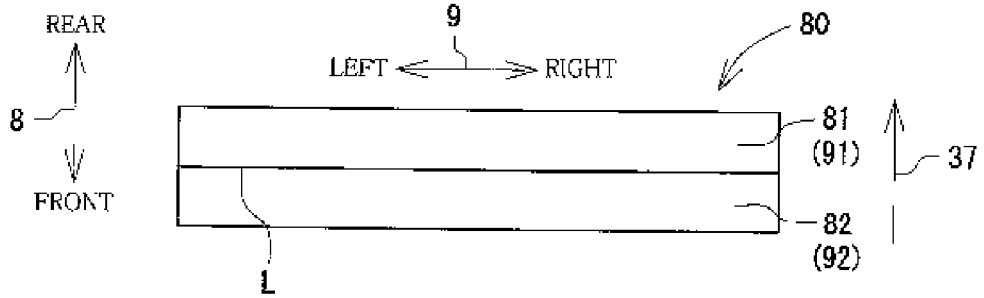

As shown in FIG. 5, the contact portion 80 is placed in a recess portion 45 which is a portion recessed from the sheet placed face 59 of the bottom plate 51. The recess portion 45 is provided so as to extend from a position below the first roller 23 to a position below the second roller 24, along the left-right direction 9.

The contact portion 80 has a rectangular shape which is long in the left-right direction 9 in a planar view and is formed like a plate which has a thickness in the up-down direction 7. A length of the contact portion 80 in the left-right direction 9 is approximately the same as a length of the recess portion 45 in the left-right direction 9. The contact portion 80 is adhered on a bottom face of the recess portion 45 and faces to the first roller 23 and the second roller 24 in the up-down direction 7.

As shown in FIG. 5A, the bottom face of the recess portion 45 is constituted by a flat face 46 and a curved face 47 in order that the sheet 6 to be supplied by a user is not caught by the contact portion 80. The curved face 47 is curved downward from a front edge of the flat face 46 in the front-rear direction 8, and is placed in an upstream side of the flat face 46 in the sheet supply direction 37.

Owing to the curved face 47, the recess portion 45 is deeper at an upstream side than a downstream side in the sheet supply direction 37. Therefore, as shown in FIG. 5A by a dash line, a downstream end of a top face of the contact portion 80 in the sheet supply direction 37 is positioned higher than the sheet placed face 59, and an upstream end of the top face of the contact portion 80 is positioned at the same height as the sheet placed face 59. Accordingly, when the user slides the sheet 6, during a supply of the sheet 6, from an upstream position of the contact portion 80 to a downstream position of the contact portion 80 in the sheet supply direction 37 (from the front to the rear), the sheet 6 is not caught by the contact portion 80. Additionally, when the sheet 6 is supplied, the sheet 6 can be supplied smoothly.

Additionally, there are provided a plurality of guide ribs 58 which guide the sheet 6 to a space above the contact portion 80, in an upstream side of the contact portion 80 in the sheet supply direction 37, in other word, in a front region of the contact portion 80 in the front-rear direction 8. The guide ribs 58 protrude upward from the bottom plate 51 and extend along the sheet supply direction 37.

The contact portion 80 is constituted by a first contact portion 81 and a second contact portion 82 which are different from each other in the friction coefficient with respect to the sheet 6, in order to prevent an occurrence of the no-feeding in which the sheet 6 is not supplied even though the sheet supply roller 19 is driven. This is described in detail below.

Each of the first contact portion 81 and the second contact portion 82 is formed to have a rectangular shape in a planar view. The first contact portion 81 is placed on the flat face 46 and faces to the first roller 23 and the second roller 24 in the up-down direction 7. The second contact portion 82 is placed on both of the flat face 46 and the curved face 47, and is positioned in an upstream side of the first contact portion 81 in the sheet supply direction 37.

The friction coefficient of the first contact portion 81 with respect to the sheet 6 is set according to a kind of the sheet 6 to be frequently conveyed, in order to prevent an occurrence of the double-feeding. In particular, the first contact portion 81 is made of a material whose friction coefficient had been set so that a friction force applied by the contact portion 80 to the sheet 6 is smaller than a conveying force of the sheet supply roller 19 (the first roller 23 and the second roller 24) and is larger than a friction force between the sheets 6. For example, the sheet 6 may be a plain paper. In this embodiment, the friction coefficient of the first contact portion 81 is set approximately at a friction coefficient of a gloss paper. As described above, since the friction coefficient of the sheet supply tray 14 is reduced in order to decrease the slide resistance generating between the arm 22 and the sheet supply tray 14 and in order to decrease the friction force generating between the sheet 6 and the inclined plate 55, the friction coefficient of the first contact portion 81 is larger than the friction coefficient of the sheet supply tray 14.

On the other hand, the friction coefficient of the second contact portion 82 with respect to the sheet 6 is, as described later, smaller than the friction coefficient of the first contact portion 81 with respect to the sheet 6 in order to prevent an occurrence of the no-feeding.

The first contact portion 81 and the second contact portion 82 have the same thickness in order to form no step between the first contact portion 81 and the second contact portion 82 on the top face of the contact portion 80. The contact portion 80 is constituted by a first pad 91, a second pad 92, a third pad 93, and a fourth pad 94 each of which is like a plate, in order that the first contact portion 81 and the second contact portion 82 have the same thickness irrespective of a dimension error which may occur in manufacturing, and in order that the friction coefficients of the contact portions 81, 82 are different from each other. The detailed description is as follows.

Figure 6B:
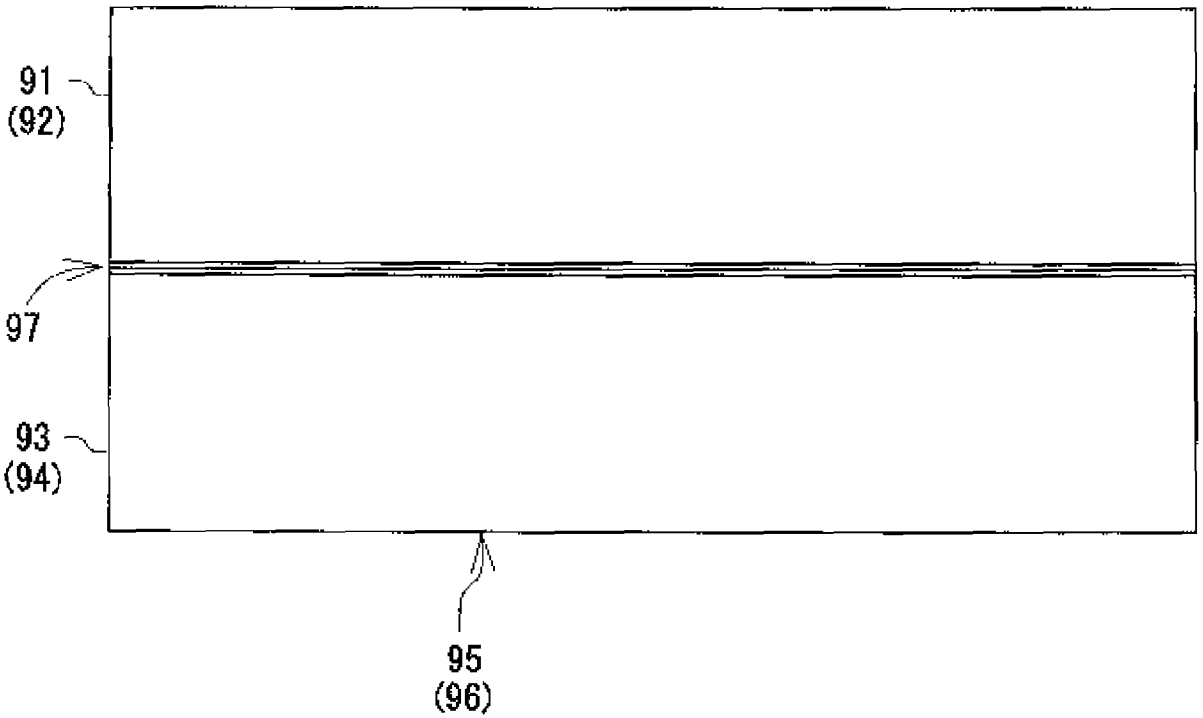
FIGS. 6A and 6B are cross-sectional views of a first cork member 95 (a second cork member 96), and a plan view of the first cork member 95 (the second cork member 96)
Figure 6A:
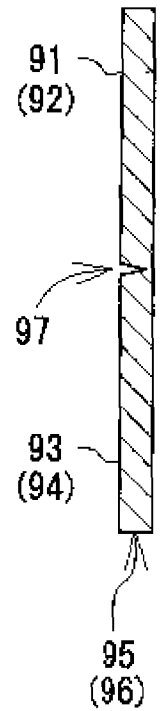

As shown in FIG. 6, a first cork member 95 like a plate having a rectangular shape in a planar view is divided into two pieces. The first cork member 95 has a groove 97 which contributes to an easy divide. One of the two pieces serves as the first pad 91 and the other of the two pieces serves as the third pad 93. This enables a manufacture of the first pad 91 and the third pad 93 having the same shape (rectangular shape) and the approximately same thickness.

A second cork member 96 having the friction coefficient smaller than the friction coefficient of the first cork member 95 and having the same shape as the first cork member 95 is divided into two pieces. One of the two pieces serves as the second pad 92 and the other of the two pieces serves as the fourth pad 94. This enables a manufacture of the second pad 92 and the fourth pad 94 which have the same shape (rectangular shape) and the approximately same thickness, and whose friction coefficient is smaller than the friction coefficient of the first pad 91.

As shown in FIG. 5A, the fourth pad 94 is adhered on the flat face 46, and the third pad 93 is adhered on the flat face 46 and the curved face 47. The first pad 91 is adhered on the fourth pad 94, and the second pad 92 is adhered on the third pad 93. The first pad 91 and the fourth pad 94 stacked in the up-down direction 7 forms the first contact portion 81. The second pad 92 and the third pad 93 stacked in the up-down direction 7 forms the second contact portion 82. Incidentally, as long as the first pad 91 and the fourth pad 94 have the same shape and the second pad 92 and the third pad 93 have the same shape, the first pad 91 and the second pad 92 may have different lengths from each other in the front-rear direction 8.

Forming the contact portion 80 as described above enables the first contact portion 81 and the second contact portion 82 to have the same thickness irrespective of a dimension error which may occur in manufacturing, and enables the friction coefficients to be different from each other. Accordingly, since the thickness is invariant, it is possible to decrease a probability of a formation of the step on the top face of the contact portion 80. This prevents an occurrence of the no-feeding of the sheet. This is later described in detail.

The double-feeding and the no-feeding are described below. When more than several pieces of sheets 6 (for example, more than three pieces of sheets 6) are placed on the sheet supply tray 14, the separating protrusion pieces 56 provided on the inclined plate 55 come into abutting contact with the sheets 6, thereby preventing the double-feeding.

When not more than several pieces of sheets 6 (for example, from one piece to three pieces of sheets 6) are placed on the sheet supply tray 14, the friction force applied by the contact portion 80 to the sheet 6 and, and the abutting contact of the separating protrusion pieces 56 with the sheets 6 prevent the double-feeding.

Next, the no-feeding which may occur when the last one of the sheets 6 is left on the sheet supply tray 14 is described in detail with reference to FIGS. 7A and 7B. Where the friction force generating between the sheet 6 and the contact portion 80 is larger than the conveying force of the sheet supply roller 19 applied to the sheet 6, the sheet 6 is not be supplied and the sheet supply roller 19 (the first roller 23 and the second roller 24) rotatingly moves on the sheet 6, that is, moves on the sheet 6 by a rotation of the sheet supply roller 19 itself. This rotating movement causes an inclination angle θ of the arm 22 relative to the sheet placed face 59 to become larger. As a result, a contact pressure between the sheet supply roller 19 and the sheet 6 (that is, a vertical load applied by the first roller and the second roller to the sheet 6) increases via the rotation shaft 29 supported by the arm 22 and the holder portion 27. As the contact pressure increases, the friction force applied by the first contact portion 81 to the sheet 6 increases.

In order to supply the sheet 6, the sheet supply roller 19 needs to applies, to the sheet 6, the friction force larger than the friction force applied by the contact portion 80 to the sheet 6. When the sheet supply roller 19 applies the friction force to the sheet 6, a reaction force (friction force) is applied by the sheet 6 to the sheet supply roller 19 in a direction opposite to the sheet supply direction 37. When this reaction force becomes larger than the friction force applied by the contact portion 80 to the sheet 6, this reaction force causes the rotating movement of the sheet supply roller 19 in which the sheet supply roller 19 moves in a direction opposite to the sheet supply direction 37. Consequently, this reaction force and the larger contact pressure described above elastically deform at least one of the frame 70, the supporting shaft 21, the arm 22, the sheet supply tray 14, the contact portion 80, and the sheet supply roller 19.

Figure 7A:
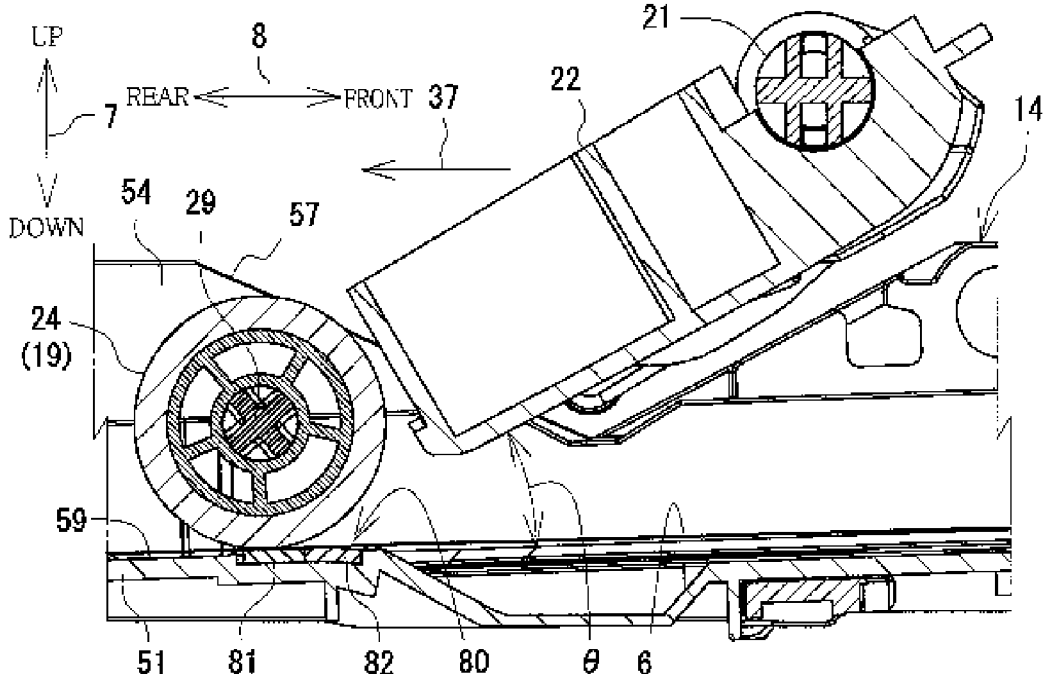
FIGS. 7A and 7B are explanatory diagrams for describing an operation of the sheet supply unit 20.
Figure 7B:
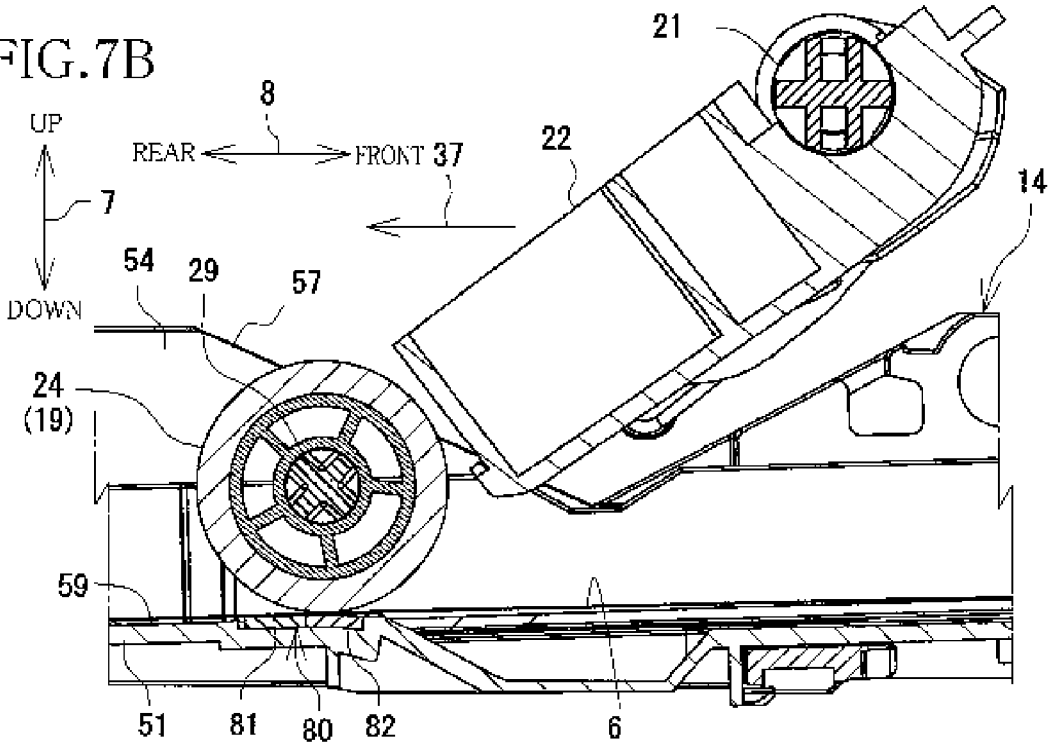

Due to the rotating movement, the sheet supply roller 19 moves from a first position shown in FIG. 7A in which the sheet supply roller 19 faces to the first contact portion 81 in the up-down direction 7 to a second position shown in FIG. 7B in which the sheet supply roller 19 faces to the second contact portion 82 in the up-down direction 7. As a result, the inclination angle θ of the arm 22 relative to the sheet placed face 59 further increases, and thus the contact pressure between the sheet supply roller 19 and the sheet 6 becomes further increases. This causes an increase of the friction force (conveying force) applied by the sheet supply roller 19 to the sheet 6. In addition, when the sheet supply roller 19 moves to the second position, the friction force is mainly applied by the second contact portion 82 to the sheet 6. Since the friction coefficient of the second contact portion 82 with respect to the sheet 6 is smaller than the friction coefficient of the first contact portion 81 with respect to the sheet 6, the friction force (a second friction force) applied by the second contact portion 82 to the sheet 6 when the sheet supply roller 19 is positioned in the second position is smaller than the friction force (a first friction force) applied by the first contact portion 81 to the sheet 6 when the sheet supply roller 19 is positioned in the first position. In other words, the friction coefficient of the second contact potion 82 which is smaller than the friction coefficient of the first contact portion 81 is set such that the second friction force is smaller than the first friction force. Based on the rotating movement of the sheet roller 19 from the first position to the second position, since the conveying force increases and the friction force applied by the contact portion 80 to the sheet 6 decreases, the sheet 6 is promptly supplied and an occurrence of the no-feeding of the sheet is prevented. Additionally, when the sheets 6 of a few pieces (two or three pieces) are placed on the sheet supply tray 14, the friction force applied by the second contact portion 82 to the sheet 6 prevents an occurrence of the double-feeding.

As describe above, since the formation of the step between the first contact portion 81 and the second contact portion 82 is decreased, an occurrence of the no-feeding is more surely prevented. This is described in detail below.

If the step were formed such that a top face of the second contact portion 82 were lower than a top face of the first contact portion 81, the sheet 6 would not be pressedly contacted with the second contact portion 82 irrespective of the movement of the sheet supply roller 19 to the second position. Additionally, if the step were formed such that the top face of the second contact portion 82 were higher than the top face of the first contact portion 81, the sheet supply roller 19 would become harder to move to the second position. Since the probability of the formation of the step is decreased, the sheet supply roller 19 promptly moves to the second position and the friction force is applied by the second contact portion 82 to the sheet 6, whereby the occurrence of the no-feeding is more surely prevented.

The sheet 6 supplied without occurrences of the double-feeding and the no-feeding is conveyed to the platen 34 by the conveyor roller pair 32 shown in FIG. 2 and is intermittently conveyed on the platen 34. While the sheet 6 is intermittently conveyed, the recording portion 40 selectively ejects ink droplets so as to record an image on the sheet 6. The sheet 6 on which the image has been recorded is discharged by the sheet discharge roller pair 33 to the sheet discharged tray 17.

The friction force applied by the contact portion 80 to the sheet 6 prevents an occurrence of the double-feeding.

Additionally, since the second contact portion 82 having the friction coefficient smaller than the friction coefficient of the first contact portion 81 is positioned in an upstream side of the first contact portion 81 in the sheet supply direction 37, the sheet 6 is promptly supplied and the occurrence of the no-feeding is prevented.

Moreover, since the contact portion 80 is constituted by the first pad 91, the second pad 92, the third pad 93, and the fourth pad 94, it is possible to decrease the probability of the formation of the step on the top face of the contact portion 80, whereby the occurrence of the no-feeding is more surely prevented.

First Modified Embodiment

In the aforementioned embodiment, an example is described in which the first contact portion 81 and the second contact portion 82 each have a rectangular shape in a planar view. In the aforementioned embodiment, a border line L between the top face of the first contact portion 81 and the top face of the second contact portion 82 is a straight line extending in the left-right direction 9. Where the contact portion 80 is provided in this manner, the friction force applied by the contact portion 80 to the sheet 6 does not decrease until the sheet supply roller 19 (FIG. 5B) moves beyond the border line L on the way from the first position to the second position. As a result, as long as an amount of the elastic deformations of the frame 70, the sheet supply tray 14, the contact portion 80, supporting shaft 21, the arm 22, and the sheet supply roller 19 becomes more than a certain amount so that the sheet supply roller 19 moves beyond the border line L, the friction force applied by the sheet 6 to the contact portion 80 does not decreases. In the first modified embodiment, an example is described in which the friction force applied by the contact portion 80 to the sheet 6 decreases in accordance with a distance of a movement in which the sheet supply roller 19 moves from the first position toward the second position, and thus the amount of the elastic deformations of the sheet supply tray 14 and so on is decreased.

Figure 8A:
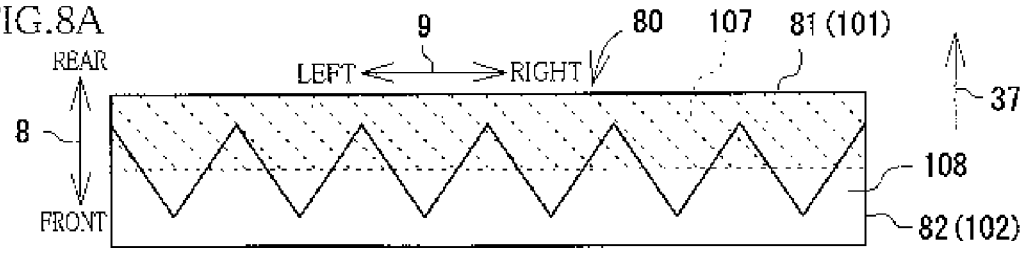
Figure 8B:
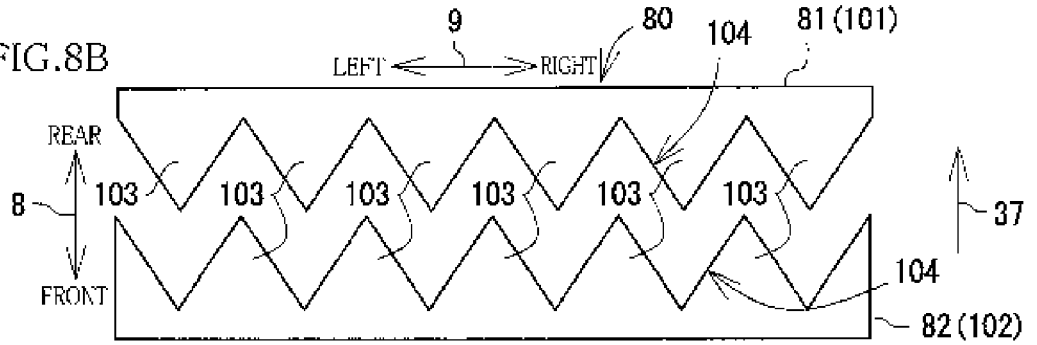

As shown in FIGS. 8A and 8B, the contact portion 80 includes a first pad 101 which constitutes the first contact portion 81, and a second pad 102 which constitutes the second contact portion 82. The first pad 101 is disposed in a downstream side of the second pad 102 in the sheet supply direction 37. A friction coefficient of the second pad 102 is smaller than a friction coefficient of the first pad 101.

The first pad 101 has a plurality of protrusions 103 which are provided on an upstream region of the first pad 101 and are arranged in the left-right direction 9. Each of the protrusions 103 has a triangular shaped in a planar view. These protrusions 103 constitute a part of a concavo-convex portion 104. Similarly, the second pad 102 has a plurality of protrusions 103 which are provided on a downstream region of the second pad 102 and are aligned in the left-right direction 9. These protrusions 103 constitute a part of the concavo-convex portion 104.

The first pad 101 and the second pad 102 are fitted at the concavo-convex portion 104 to each other. Since the protrusions 103 each have a triangular shape, the first pad 101 and the second pad 102 are fitted to each other without any clearance.

Figure 8C:
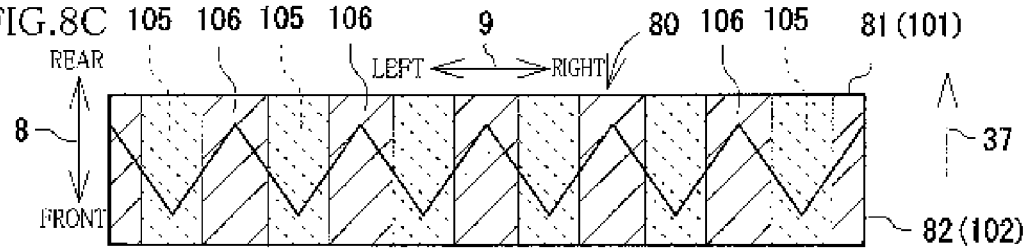

In the contact portion 80 constituted as described above, a plurality of first regions 105 indicated in FIG. 8C by a hatching of broken lines and a plurality of second regions 106 indicated in FIG. 8C by a hatching of narrow lines are formed on the contact portion 80. The first region 105 is a region in which a length of the first pad 101 is longer in the sheet supply direction 37 than a length of the second pad 102. The second region 106 is a region in which the length of the second pad 102 is longer in the sheet supply direction 37 than the length of the first pad 101. The first region 105 and the second region 106 are alternately arranged in the left-right direction 9. Since the first region 105 and the second region 106 are formed on the contact portion 80, the friction force applied by the contact portion 80 to the sheet 6 decreases in accordance with the distance of the movement in which the sheet supply roller 19 moves from the first position toward the second position. This is described in detail below.

When the sheet supply roller 19 is at the first position, the first roller 23 and the second roller 24 (FIG. 5B) face, in the up-down direction 7, to a third region 107 indicated in FIG. 8A by a hatching of dotted lines. Therefore, the sheet 6 is pressedly contacted with the contact portion 80 at the third region 107. A ratio of an area of the first pad 101 in the third region 107 to an area of the second pad 102 in the third region 107 is larger than a ratio of an area of the first pad 101 in the fourth region 108 to an area of the second pad in the fourth region 108. The ratio of the areas gradually decreases as a point on the contact portion 80 moves from the third region 107 to the fourth region 108. Therefore, when the sheet supply roller 19 moves from the first position to the second position, the friction force applied by the contact portion 80 to the sheet 6 decreases in accordance with the distance of the movement of the sheet supply roller 19 from the third region. Accordingly, the sheet 6 can be supplied before the sheet supply roller 19 has reached to the second position. As a result, the sheet 6 is promptly supplied, and the amount of the elastic deformations of the frame 70, the sheet supply tray 14, the contact portion 80, the supporting shaft 21, the arm 22 and the sheet supply roller 19 can be decreased.

Figure 8D:
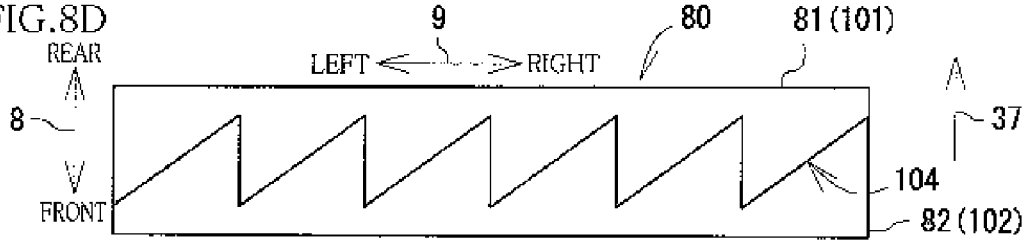
Figure 8E:
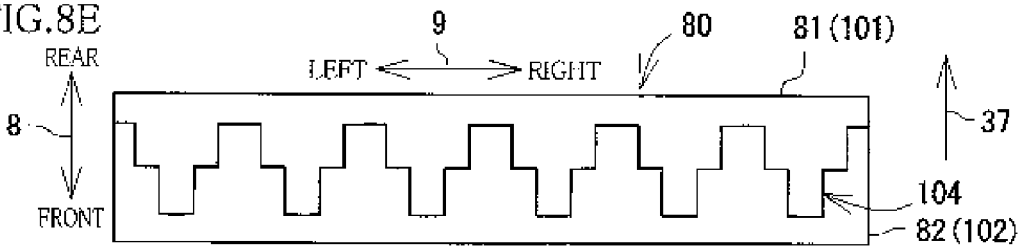

It is noted that the concavo-convex portion 104 is not limited to the shape using a triangle but may have any shape in which a ratio of an area of the second contact portion 82 to an area of the first contact portion 81 increases as a point on the contact portion 80 moves toward the upstream side in the sheet supply direction 37 (to a front in the front-rear direction 8). For example, the concavo-convex portion 104 may have a sawtooth shape (wavy shape) as shown in FIG. 8D. Alternately, as shown in FIG. 8E, the concavo-convex portion 104 may have a step-like shape in which an area of the top face decreases as a point on the contact portion 80 moves to an end of a protrusion.

In order to decrease the probability of the formation of the step on the top face of the contact portion 80, the first contact portion 81 and the second contact portion 82 are formed by stacking two pads in the up-down direction 7 in the same way as the aforementioned embodiment.

Second Modified Embodiment

In the aforementioned embodiment, an example is described in which the friction force applied by the contact portion 80 to the sheet 6 is decreased by utilizing the movement of the sheet supply roller 19 (FIG. 5B) from the first position to the second position. In the second modified embodiment, an example is described in which the friction force applied by the contact portion 80 to the sheet 6 is decreased by utilizing not only the movement of the sheet supply roller 19 but also a bend of the rotation shaft 29.

Figure 9A:
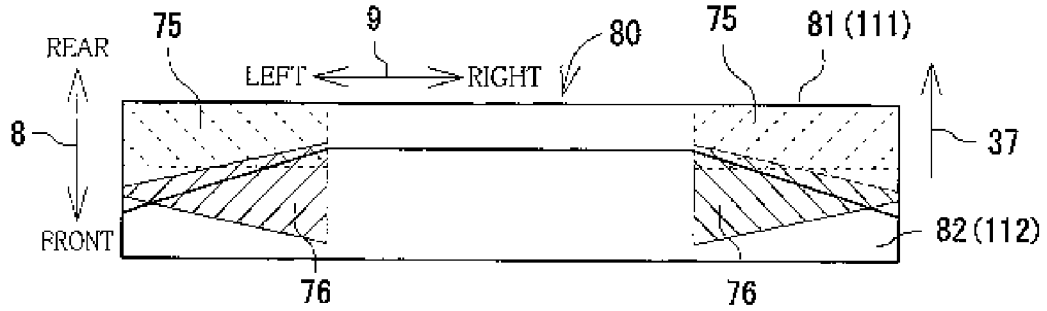
Figure 9B:
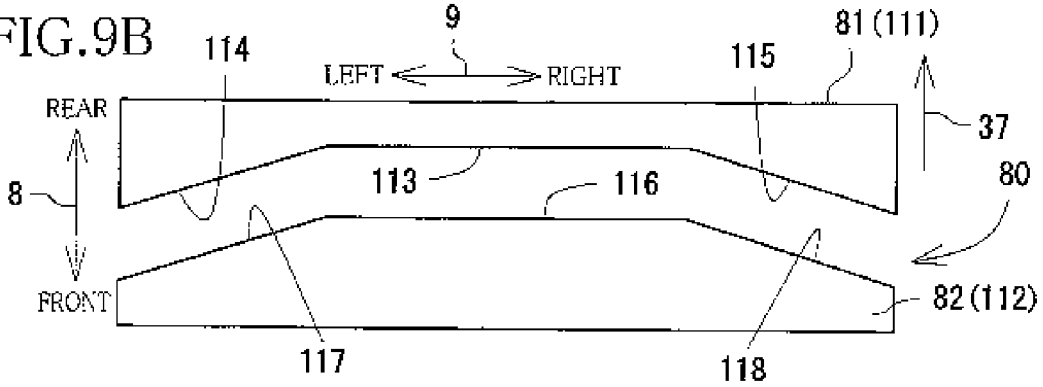

As shown in FIGS. 9A and 9B, the contact portion 80 includes a first pad 111 which constitutes the first contact portion 81, and a second pad 112 which constitutes the second contact portion 82. The first pad 111 is disposed in a downstream side of the second pad 112 in the sheet supply direction 37. A friction coefficient of the second pad 112 is smaller than a friction coefficient of the first pad 111.

The first pad 111 has a central portion 113, a left inclined portion 114, and a right inclined portion 115 in an upstream edge of the first pad 111 in the sheet supply direction 37 (in a front edge in the front-rear direction 8). The central portion 113 is disposed in a center of the first pad 111 in the left-right direction 9 and extends in the left-right direction 9. The left inclined portion 114 extends leftward and forward from a left end of the central portion 113, and is thus inclined relative to the central portion 113 in a planar view. The right inclined portion 115 extends rightward and forward from a right end of the central portion 113, and is thus inclined relative to the central portion 113 in a planar view.

The second pad 112 has a central portion 116, a left inclined portion 117, and a right inclined portion 118 in a downstream edge of the second pad 112 in the sheet supply direction 37 (in a rear edge in the front-rear direction 8). The central portion 116 is arranged in a center of the second pad 112 in the left-right direction 9 and extends in the left-right direction 9. The left inclined portion 117 extends leftward and forward from a left end of the central portion 116, and is thus inclined relative to the central portion 116 in a planar view. The right inclined portion 118 extends rightward and forward from a right end of the central portion 116, and is thus inclined relative to the central portion 116 in a planar view.

The first pad 111 and the second pad 112 are fitted to each other such that the central portion 113 comes into abutting contact with the central portion 116, the left inclined portion 114 comes into abutting contact with the left inclined portion 117, and the right inclined portion 115 comes into abutting contact with the right inclined portion 118. The contact portion 80 formed as described above is constituted such that, in a left portion of the contact portion 80 including the left inclined portions 114, 117 (which is an example of a first receiving portion), as a point on the left portion of the contact portion 80 comes closer from a left end of the left inclined portions 114, 117 to the central portions 113, 116, a length of the first pad 111 at the point in the sheet supply direction 37 becomes shorter and a length of the second pad 112 at the point in the sheet supply direction 37 becomes longer. Accordingly, in the left portion, a ratio of an area of a top face of the second pad 112 to an area of a top face of the first pad 111 is larger at a part of the left portion closer to the central portions 113, 116. Similarly, in a right portion of the contact portion 80 including the right inclined portions 115, 118 (which is an example of a second receiving portion), a ratio of the area of the top face of the second pad 112 to the area of the top face of the first pad 111 is larger at a part of the right portion closer to the central portions 113, 116.

When the relatively large number of the pieces of the sheets 6 are placed on the sheet supply tray 14 and the sheet supply roller 19 is at the first position, the sheet supply roller 19 face, in the up-down direction 7, to a fifth region 75 indicated in FIG. 9A by a hatching of broken lines. Therefore, the sheet 6 is pressedly contacted with the contact portion 80 at the fifth region 75.

Figure 9C:
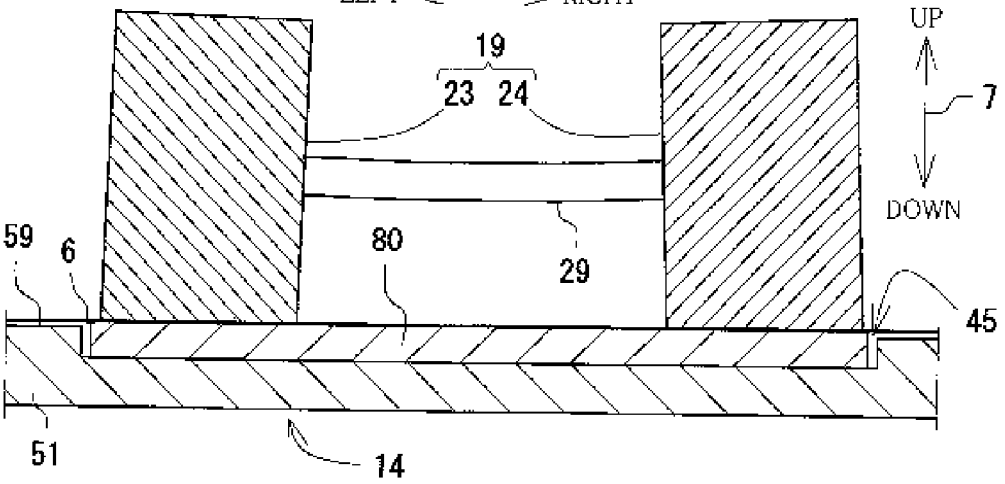

When the sheets 6 placed on the sheet supply tray 14 are reduced and the number of the sheets 6 becomes equal to or less than the several pieces, the contact pressure between the sheet supply roller 19 and the sheet 6 becomes larger than before the reduction, and thus the sheet supply roller 19 moves from the first position to the second position (in the direction opposite to the sheet supply direction 37). In addition, as shown in FIG. 9C, when the contact pressure between the sheet supply roller 19 and the sheet 6 becomes relatively large, the rotation shaft 29 is bent. Consequently, the first roller 23 and the second roller 24 are pressedly contacted with the sheet 6 at respective insides of the rollers 23, 24 in the left-right direction 9 (at respective sides of the rollers 23, 24 facing to each other).

Therefore, the sheet 6 is pressedly contacted with the contact portion 80 at a sixth region 76 indicated in FIG. 9A by a hatching of narrow lines.

As described above, the region where the sheet 6 is pressedly contacted with the contact portion 80 is moved from the fifth region 75 to the sixth region 76 due to the movement of the sheet supply roller 19 and the bend of the rotation shaft 29. Since the first pad 111 has the left inclined face 114 and the right inclined face 115, and the second pad 112 has the left inclined face 117 and the right inclined face 118, it is possible to decrease the friction force applied by the contact portion 80 to the sheet 6 even though the distance of the movement the sheet supply roller 19 is short. As a result, the occurrence of the no-feeding of the sheet is prevented, and the amount of the elastic deformations of the frame 70, the sheet supply tray 14, the contact portion 80, the supporting shaft 21, the arm 22, and the sheet supply roller 19 can be decreased.

In order to decrease the probability of the formation of the step on the top face of the contact portion 80, the first contact portion 81 and the second contact portion 82 are formed by stacking two pads in the up-down direction 7 in the same way as the aforementioned embodiment.

Third Modified Embodiment

Figure 10A:
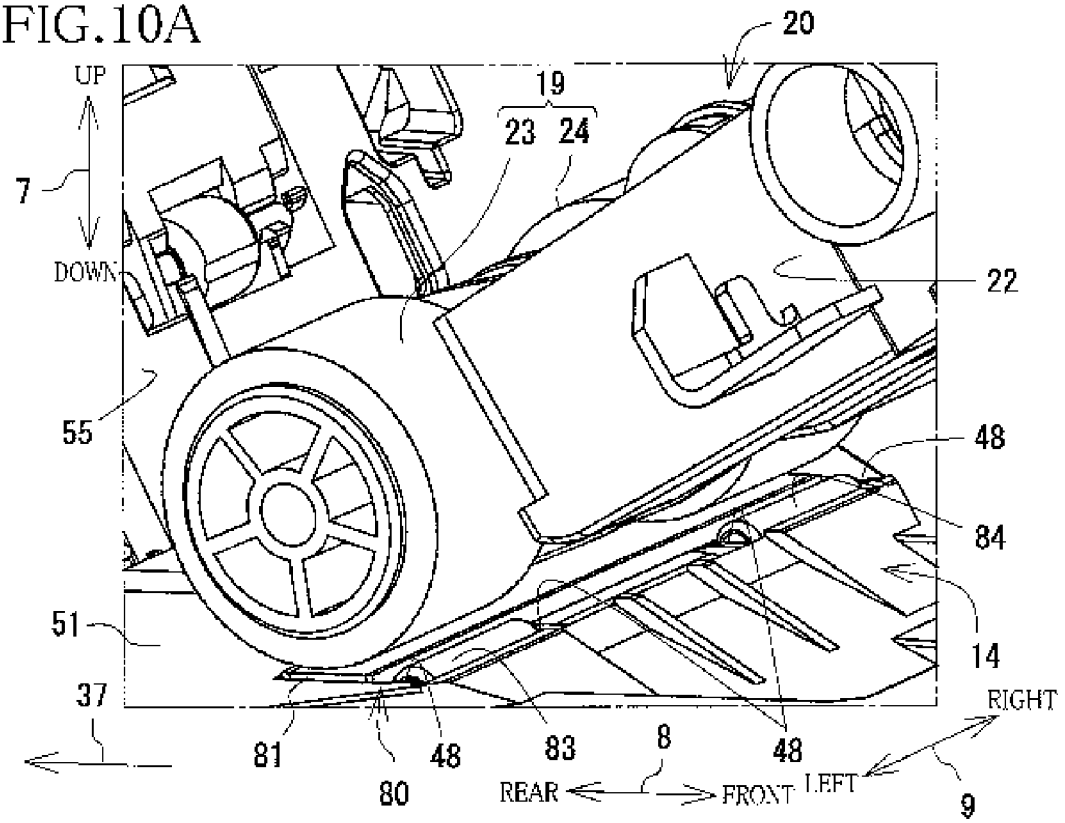
Figure 10B:
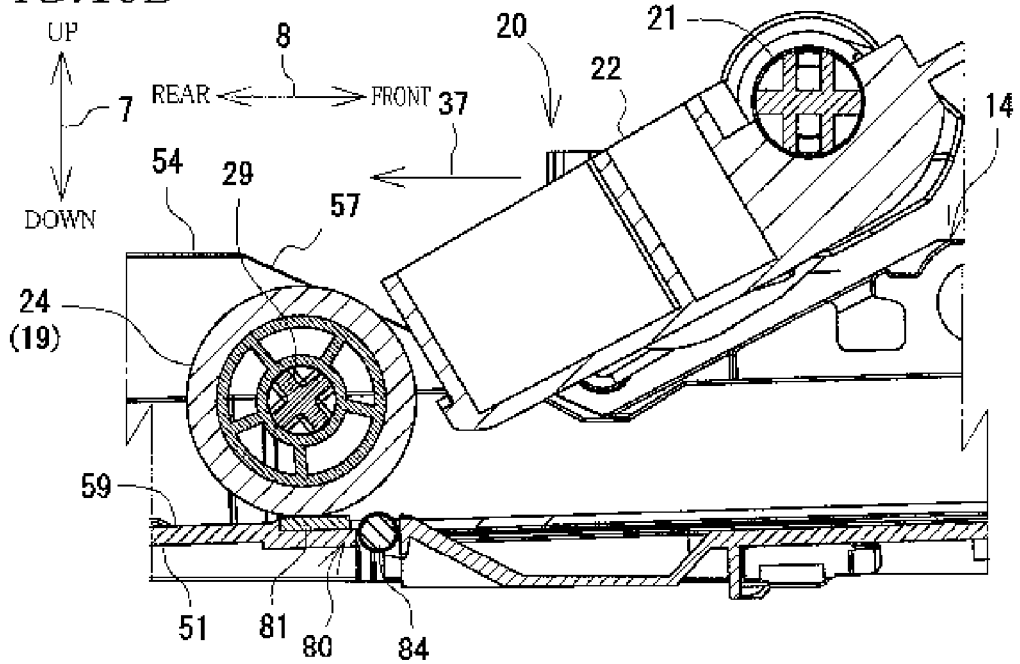

As shown in FIG. 10, in the third modified embodiment, an example is described in which a pair of passive rollers 83, 84 aligned in the left-right direction 9 are provided instead of the second contact portion 82 (FIG. 3). The passive roller 83 is placed below the first roller 23. The passive roller 84 is placed below the first roller 24. The passive rollers 83, 84 are each formed into a column shape whose central axis extends in the left-right direction 9. A rotation shaft not shown in the drawings protrudes leftward and rightward from both side faces of the passive roller 83. Similarly, a rotation shaft not shown in the drawings protrudes leftward and rightward from both side faces of the passive roller 84. In the recess portion 45, four bearings 48 having respective holes (not shown in the drawings) are each provided at each side of the passive rollers 83, 84. Each end of the rotation shafts of the passive rollers 83, 84 is inserted into the corresponding holes of the four bearings 48. Accordingly, The passive rollers 83, 84 are rotatably supported by the bearings 48.

When the rotating movement of the sheet supply roller 19 is caused and then the sheet supply roller 19 moves to the second position (FIG. 7B), the sheet 6 is pressedly contacted with the passive rollers 83, 84 by the sheet supply roller 19. Accordingly, the sheet 6 receives a resistance force against the supply of the sheet 6 from the passive rollers 83, 84. This resistance force has a magnitude according to a friction force applied by the bearings 48 to the passive rollers 83, 84. As a result, a decrease of the resistance force applied to the sheet 6 can be achieved more easily than the embodiment provided with the second contact portion 82 (FIG. 3), whereby the occurrence of the no-feeding is more surely prevented.

Incidentally, though the example in which the pair of the passive rollers 83, 84 is provided is described above, a single passive roller whose length is equal to a length between both side faces of the recess portion 45 may be provided.

Fourth Modified Embodiment

Figure 11A:
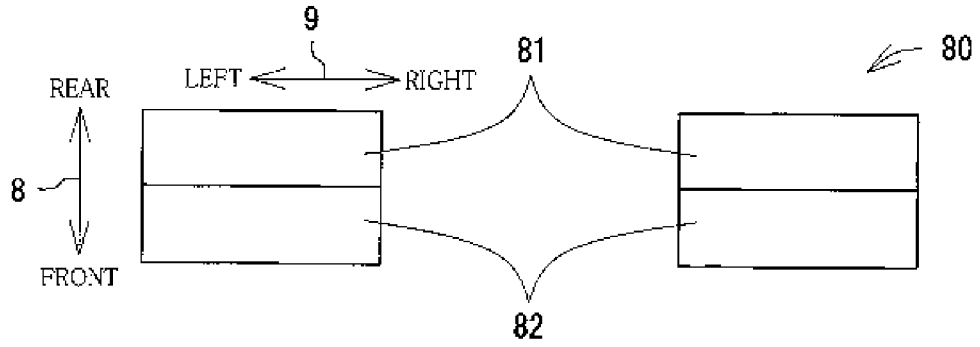
FIG. 11A-11C are plan views of contact portions 80 of other modified embodiments.
Figure 11B:
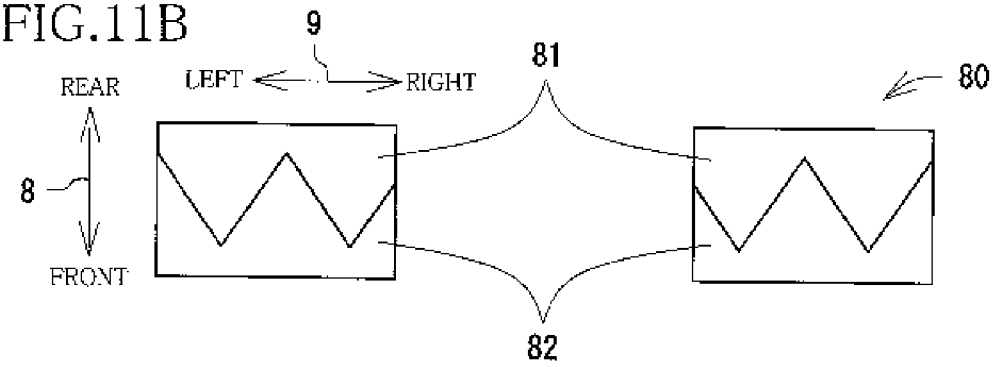
Figure 11C:
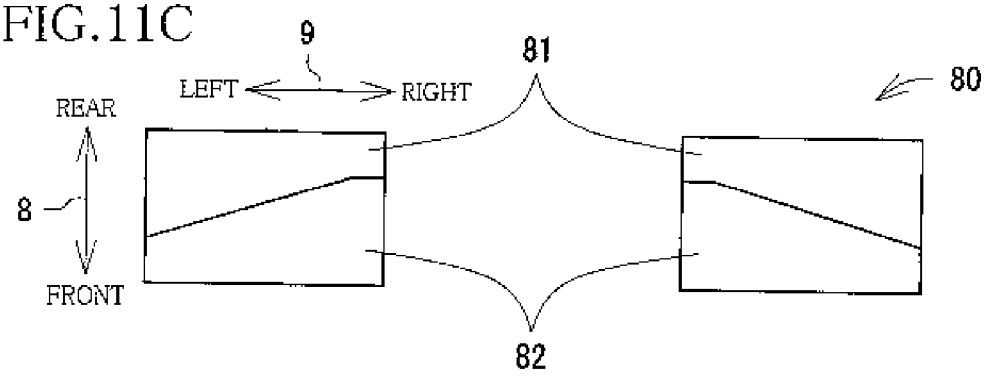

As shown in FIG. 3, since the central portion of the contact portion 80 in the left-right direction 9 does not face to the first roller 23 and the second roller 24, the occurrences of the double-feeding and the no-feeding can be prevented without the central portion. Therefore, as shown in FIGS. 11A-11C, the contact portion 80 may be constituted by only the left and right side portions (the contact portions 81, 82) of the contact portion 80 of the aforementioned embodiment and the first, second, and third modified embodiments, so as to be provided in the sheet supply tray 14.

Other Embodiments

In the aforementioned embodiment and the first, third, and fourth modified embodiments, the examples are described in each of which the two rollers, that is, the first roller 23 and the second roller 24, are provided for the sheet supply unit 20. However, one roller, or three or more rollers may be provided for the sheet supply unit 20. Additionally, in the third modified embodiment, two or more rollers may be provided in each of both sides of the holder portion 27 of the arm 22 in the left-right direction 9.

In addition, in the aforementioned embodiment and the fourth modified embodiment, when the sheet supply roller 19 is positioned in the first position, the first position faces to the first contact portion 81, and when the first supply roller 19 is positioned in the second position, the second position faces to the second contact portion 82. However, (a) where a region of a contact portion to which a first position faces is served as a first contact portion when a sheet supply roller is positioned in the first position, and (b) where a region of the contact portion to which a second position faces is served as a second contact portion when the sheet supply roller is positioned in the second position, (i) the region corresponding to the first contact portion can be defined as a region which includes at least one of a region including at least a part of the first contact portion 81 and not including the second contact portion 82, and a region including the at least a part of the first contact portion 81 and at least a part of the second contact portion 82, and (ii) the region corresponding to the second contact portion can be defined as a region which includes at least one of a region including the at least a part of the second contact portion 82 and not including the first contact portion 81, and a region including the at least a part of the first contact portion 81 and the at least a part of the second contact portion 82.

In a case in which the first contact portion and the second contact portion are defined as described above, when a ratio of an area of the first pad 91 in the first contact portion to an area of the second pad 92 in the first contact portion is set to be larger than a ratio of an area of the first pad 91 in the second contact portion to an area of a second pad 92 in the second contact portion, the friction coefficient of the second contact potion is set to be smaller than the friction coefficient of the first contact potion. It is noted that the first contact portion and the second contact portion face to the first position and the second position, respectively, and are portions of the contact portion which substantially come into abutting contact with the sheet when the sheet supply roller supplies the sheet. That is, when the plural sheets 6 are placed on a sheet support portion, a portion of the contact portion which substantially comes into abutting contact with the bottom one of the plural sheets when the sheet supply roller in the first position supplies the top one of the plural sheets, corresponds to the first contact portion; when the single sheet is placed on the sheet support portion, a portion of the contact portion which substantially comes into abutting contact with the single sheet when the sheet supply roller in the second position supplies the single sheet, corresponds to the second contact portion.

Additionally, in the first modified embodiment described above, when the sheet supply roller 19 is positioned in the first position, the first position faces to the third region 107, and when the first supply roller 19 is positioned in the second position, the second position faces to the fourth region 108. In the first modified embodiment, (i) the region corresponding to the first contact portion can be defined as at least one of a region including at least a part of the third region 107 and not including the fourth region 108, and a region including the at least a part of the third region 107 and at least a part of the fourth region 108, and (ii) the region corresponding to the second contact portion can be defined as at least one of a region including the at least a part of the fourth region 108 and not including the third contact region 107, and a region including the at least a part of the third region 107 and the at least a part of the fourth region 108

In a case in which the first contact portion and the second contact portion are defined as described above, when a ratio of an area of the first pad 101 in the first contact portion to an area of the second pad 102 in the first contact portion is set to be larger than a ratio of an area of the first pad 101 in the second contact portion to an area of a second pad 102 in the second contact portion, the friction coefficient of the second contact potion is set to be smaller than the friction coefficient of the first contact potion.

Additionally, in the second modified embodiment described above, when the sheet supply roller 19 is positioned in the first position, the first position faces to the fifth region 75, and when the first supply roller 19 is positioned in the second position, the second position faces to the sixth region 76. In a case in which at least a part of the fifth region 75 corresponds to the first contact portion and at least a part of the sixth region 76 corresponds to the second contact portion, when a ratio of an area of the first pad 111 in the first contact portion to an area of the second pad 112 in the first contact portion is set to be larger than a ratio of an area of the first pad 111 in the second contact portion to an area of a second pad 112 in the second contact portion, the friction coefficient of the second contact potion is set to be smaller than the friction coefficient of the first contact potion.

In the aforementioned embodiment and the modified embodiments, the examples are described in each of which the sheets 6 are positioned owing to the center positioning manner, and the contact portion 80 is arranged in the central portion of the bottom plate 51 in the left-right direction 9. However, the position of the contact portion 80 is not limited to the central portion. For example, where the sheets 6 are positioned so that left edges of the sheets 6 are positioned at a left edge of the bottom plate 51 in the left-right direction 9 or so that right edges of the sheets 6 are positioned at a right edge of the bottom plate 51 in the left-right direction 9, the contact portion 80 may be arranged in a position closer to the left edge or the right edge of the bottom plate 51.

In the aforementioned embodiment and the modified embodiments, the examples are described in each of which the contact portion 80 has a rectangular shape in a planar view. However, the shape of the contact portion 80 is not limited to the rectangular shape. As long as the first contact portion 81 and the second contact portion 82 are provided, the contact portion 80 may have a different shape.

In the aforementioned embodiment, the example is described in which the contact portion 80 is constituted by the first pad 91, the second pad 92, the third pad 93, and the fourth pad 94 in order to decrease the probability of the formation of the step on the top face of the contact portion 80.
However, where the thickness of the first contact portion 81 and the thickness of the second contact portion 82 are formed so as to be the same, the first contact portion 81 may be formed only by the first pad 91 and the second contact portion 92 may be formed only by the second pad 92.

In the aforementioned embodiment and the modified embodiments, the examples are described in each of which a cork is used for a material of the contact portion 80. However, the material of the contact portion 80 is not limited to the cork, and a plastic or a rubber may be used alternately.

In the aforementioned embodiment and the modified embodiments, the examples are described in each of which the contact portion 80 is adhered on the bottom face of the recess portion 45. However, a different manner may be employed as long as the contact portion 80 may be fixed in the sheet supply tray 14.

In the aforementioned embodiment and the modified embodiments, the examples are described in each of which the sheet supply apparatus according to the present invention is employed in the image recording apparatus 10. However, the sheet supply apparatus according to the present invention may be employed in a scanner.

What is claimed is:

1. A sheet supply apparatus comprising:

a sheet support portion configured to support at least one sheet;

a supporting shaft supported by a main body of the sheet supply apparatus;

an arm configured to pivot around the supporting shaft;

a sheet supply roller provided at a distal end of the arm and configured to supply the at least one sheet in a sheet supply direction in which the at least one sheet is supplied; and a contact portion fixed to the sheet support portion and facing to the sheet supply roller, wherein the contact portion comprises:

a first contact portion; and a second contact portion disposed in an upstream side of the first contact portion in the sheet supply direction and having a friction coefficient smaller than a friction coefficient of the first contact portion, wherein the sheet supply roller is configured to move from a first position at which the sheet supply roller faces to the first contact portion to a second position at which the sheet supply roller faces to the second contact portion, by an elastic deformation of at least one of the sheet support portion, the contact portion, the supporting shaft, the arm, and the sheet supply roller.

2. The sheet supply apparatus according to claim 1, wherein the contact portion comprises:

a first pad constituting the first contact portion and configured to apply a friction force to the at least one sheet; and a second pad constituting the second contact portion, having a friction coefficient smaller than a friction coefficient of the first pad, and configured to apply a friction force to the at least one sheet.

3. The sheet supply apparatus according to claim 1, wherein the contact portion comprises:

a region constituted by a first pad configured to apply a friction force to the at least one sheet; and a region constituted by a second pad having a friction coefficient smaller than a friction coefficient of the first pad and configured to apply a friction force to the at least one sheet, and wherein the first contact portion and the second contact portion are configured such that a ratio of an area of the first pad in the first contact portion to an area of the second pad in the first contact portion is larger than a ratio of an area of the first pad in the second contact portion to an area of the second pad in the second contact portion.

4. The sheet supply apparatus according to claim 1, wherein the first contact portion is a region abutting contact with a bottom one of a plural of sheets as the at least one sheet when the sheet supply roller supplies a top one of the plural sheet while positioning at the first position, and wherein the second contact portion is a region abutting contact with a single sheet as the at least one sheet when the sheet supply roller supplies the single sheet while positioning at the second position.

5. The sheet supply apparatus according to claim 1, wherein the contact portion comprises, in at least a part thereof, a region constituted by a first pad configured to apply a friction force to the at least one sheet, and a region constituted by a second pad having a friction coefficient smaller than a friction coefficient of the first pad and configured to apply a friction force to the at least one sheet, and wherein the contact portion comprises a first region, as the first contact portion, in which the first pad is longer in the sheet supply direction than the second pad, and a second region, as the second contact portion, in which the second pad is longer in the sheet supply direction than the first pad.

6. The sheet supply apparatus according to claim 1, wherein the contact portion comprises, in at least a part thereof, a region constituted by a first pad configured to apply a friction force to the at least one sheet, and a region constituted by a second pad having a friction coefficient smaller than a friction coefficient of the first pad and configured to apply a friction force to the at least one sheet, wherein the sheet supply roller comprises a first roller and a second roller which are aligned in a direction perpendicular to the sheet supply direction, wherein the first roller and the second roller are connected by an elastically deformable connection member, wherein the connection member is supported by the arm between the first roller and the second roller, wherein the contact portion comprises (i) a first receiving portion including a region constituted by the first pad and a region constituted by the second pad, the first receiving portion being configured to face to the first roller, and (ii) a second receiving portion including a region constituted by the first pad and a region constituted by the second pad, the second receiving portion being configured to face to the second roller, wherein the first receiving portion is configured such that a ratio of a length of the second pad in the sheet supply direction to a length of the first pad in the sheet supply direction is larger at a part of the first receiving portion closer to the arm in a direction from the first roller toward the arm, the direction being perpendicular to the sheet supply direction, and wherein the second receiving portion is configured such that a ratio of the length of the second pad in the sheet supply direction to the length of the first pad in the sheet supply direction is larger at a part of the second receiving portion closer to the arm in a direction from the second roller toward the arm, the direction being perpendicular to the sheet supply direction.

7. The sheet supply apparatus according to claim 6, further comprising:

a transmission mechanism which transmits a drive force to the sheet supply roller, wherein the connection member is configured to receive the drive force is transmitted from the transmission mechanism and to transmit the driving force to the connection member at a portion of the connection member between the first roller and the second roller.

8. The sheet supply apparatus according to claim 7, wherein the transmission mechanism comprises at least one transmission gear, and wherein the connection member comprises at least one passive gear which meshes with the at least one transmission gear.

9. The sheet supply apparatus according to claim 1, wherein the contact portion comprises, in at least a portion of the contact portion, a region constituted by a first pad configured to apply a friction force to the at least one sheet, and a region constituted by a second pad having a friction coefficient smaller than a friction coefficient of the first pad and configured to apply a friction force to the at least one sheet, wherein a fourth pad having the same thickness as the second pad is interposed between the first pad and the sheet support portion, and wherein a third pad having the same thickness as the first pad is interposed between the second pad and the sheet support portion.

10. The sheet supply apparatus according to claim 1, wherein the second contact portion is configured such that an upstream end of the second contact portion in the sheet supply direction is positioned lower than a downstream end of the second contact portion in the sheet supply direction.

11. A sheet supply apparatus comprising:

a sheet support portion configured to support at least one sheet;

a supporting shaft supported by a main body of the sheet supply apparatus;

an arm configured to pivot around the supporting shaft;

a sheet supply roller provided at a distal end of the arm and configured to supply the at least one sheet in a sheet supply direction in which the at least one sheet is supplied; and a contact portion facing to the sheet supply roller, wherein the contact portion comprises:

a first contact portion fixed to the sheet support portion; and a passive roller disposed in an upstream side of the first contact portion in the sheet supply direction and rotatably supported by the sheet support portion, and wherein the sheet supply roller is configured to move from a first position at which the sheet supply roller faces to the first contact portion to a second position at which the sheet supply roller faces to the passive roller, by an elastic deformation of at least one of the sheet support portion, the contact portion, the supporting shaft, the arm, and the sheet supply roller.

* * * * *